US006833197B1

(12) United States Patent
Dong et al.

(10) Patent No.: US 6,833,197 B1
(45) Date of Patent: Dec. 21, 2004

(54) METHOD OF CASE HARDENING

(75) Inventors: Hanshan Dong, Birmingham (GB); Peter Harlow Morton, Solihull (GB); Andrew Bloyce, Worcestershire (GB); Thomas Bell, Merseyside (GB)

(73) Assignee: The University of Birmingham, Birmingham (GB)

( * ) Notice: Subject to any disclaimer, the term of this patent is extended or adjusted under 35 U.S.C. 154(b) by 0 days.

(21) Appl. No.: 09/463,042

(22) PCT Filed: Jul. 15, 1998

(86) PCT No.: PCT/GB98/02082

§ 371 (c)(1),
(2), (4) Date: Jun. 26, 2002

(87) PCT Pub. No.: WO99/04055

PCT Pub. Date: Jan. 28, 1999

(30) Foreign Application Priority Data

Jul. 19, 1997 (GB) ..... 9715175

(51) Int. Cl.[7] ..... C23C 8/10

(52) U.S. Cl. ..... 428/472.1; 148/237; 148/276; 148/281

(58) Field of Search ..... 148/217, 237, 148/276, 281; 428/472, 472.1

(56) References Cited

U.S. PATENT DOCUMENTS 5,316,594 A * 5/1994 Kemp ..... 148/281
5,415,704 A * 5/1995 Davidson ..... 148/316
5,588,443 A 12/1996 Davidson ..... 128/772
6,206,563 B1 * 3/2001 Dombre et al. ..... 368/294
6,221,173 B1 * 4/2001 Shibuya et al. ..... 148/223
6,451,129 B2 * 9/2002 Sato et al. ..... 148/237

FOREIGN PATENT DOCUMENTS

| | | |
|---|---|---|
| EP | 0 244 253 | 11/1987 |
| JP | 61-069556 | * 4/1986 |
| JP | 61207568 | 9/1986 |
| JP | 30362560 | 2/1991 |
| JP | 03294471 | 12/1991 |
| WO | WO 96/23908 | 8/1996 |

OTHER PUBLICATIONS

"*The Oxidation of Zirconium in Oxygen–Nitrogen Atmospheres*" by Casimir Rosa et al., pps. 470–474, Jan. 14, 1980 as appeared in Z. Metallkde.

"*Surface Hardening of Titanium by Oxygen*" by Akira Takamura, pps. 10–14, as appeared in Trans JIM 1962, vol. 3.

* cited by examiner

*Primary Examiner*—George Wyszomierski
(74) *Attorney, Agent, or Firm*—Ohlandt Greeley Ruggiero & Perle

(57) ABSTRACT

A method of case hardening an article formed of titanium, zirconium or an alloy of titanium and/or zirconium is disclosed. First, the article is heat-treated in an oxidizing atmosphere at a temperature in the range of 700 to 1000° C. so as to form an oxide layer on the article. Then, the article is further heat-treated in a vacuum or in a neutral or inert atmosphere at a temperature in the range of 700 to 1000° C. so as to cause oxygen from the oxide layer to diffuse into the article.

20 Claims, 4 Drawing Sheets

METHOD OF CASE HARDENING

Figure 1:
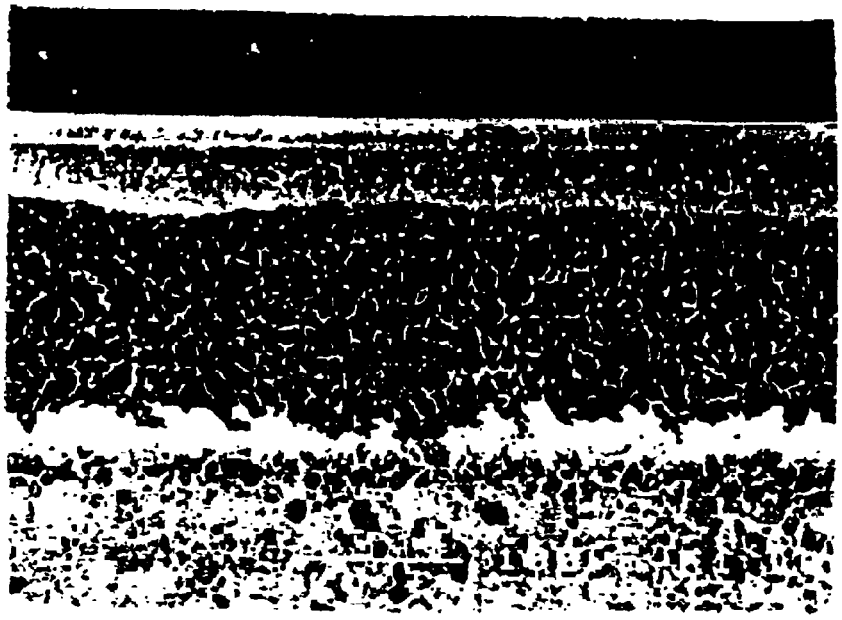

This invention relates to a method of case hardening and is more particularly concerned with a method of case hardening an article formed of titanium, zirconium or an alloy of titanium and/or zirconium.

In engineering applications, when a surface is subjected to a high contact load by another body, internal stresses are developed below the surface, the so-called Hertzian stresses. These stresses reach a maximum at a certain depth below the surface. Consequently, in order to withstand such stresses, it is necessary for a case-hardened layer to provide increased strength (and therefore hardness) down to at least that depth. At the same time, it is desirable to avoid excessive hardness at the surface itself as this could cause embrittlement. To reconcile these requirements, it is generally preferred to produce a hardness profile, in the direction normal to the surface, which has a sigmoid shape (see, for example, the OD curve in accompanying FIG. 2), consisting of a region of relatively high hardness maintained to a certain depth below the surface before dropping more steeply and then gradually to the hardness of the untreated core material.

Both theoretical and experimental work has shown that significant improvements in the load-bearing capacity of a hard coating/sub structure system can be achieved provided that, in addition to a high interfacial adhesion strength, the substrate can firmly withstand the applied load without appreciable plastic deformation. This means that deep case surface engineering processes are beneficial for subsequent hard thin coatings on titanium alloys in view of their inherent low yield strengths and low elastic moduli. However, most titanium alloys, unlike ferrous materials, cannot be hardened to a great extent by conventional surface engineering techniques since there is no hardening reaction in titanium alloys comparable to the martensite transformation in ferrous materials. Notwithstanding the fact that titanium alloys can be deeply hardened by electron beam surface alloying, it is still difficult in practice to achieve controlled reproducibility of composition in the alloyed surface layer. Oxidising titanium alloys at a high oxidation temperature for an extended period of time can also produce a deep hardened case. However, simple oxidation at higher temperatures (greater than 700° C.) is prone to the formation of severe scaling, resulting in a crumbly surface oxide layer. The present invention relates to a method which avoids this by oxidation treatment at an elevated temperature effected for a relatively short period of time, followed by a subsequent heat treatment operation.

A method of surface hardening titanium by oxygen is disclosed by A. Takamura (Trans JIM, 1962, Vol. 3, pages 10–14). In one of the methods disclosed by Takamura, samples of commercial titanium are annealed, polished and degreased and are then oxidised in dry oxygen at 850° C. for 1 or 1.5 hours. A thin oxide scale is formed on the surface of the samples. Then, the thus-oxidised samples are subjected to a diffusion treatment at 850° C. for 24 hours in argon so as to cause oxygen to diffuse into the sample. In other methods disclosed by Takamura, the oxidised samples are diffusion treated first in argon and then in nitrogen or are diffusion treated in nitrogen. In no case, however, is the desirable sigmoid-shaped hardness profile achieved.

It is an object of the present invention to provide a process which is more capable of achieving the desirable sigmoid-shaped hardness profile than the last-mentioned publication.

According to a first aspect of the present invention, there is provided a method of case hardening an article formed of titanium, zirconium or an alloy of titanium and/or zirconium, said method comprising the steps of (a) heat-treating the article formed of titanium, zirconium or alloy of titanium and/or zirconium in an oxidising atmosphere containing both oxygen and nitrogen at a temperature in the range of 700 to 1000° C. so as to form an oxide layer on the article; and (b) further heat-treating the article in a vacuum or in a neutral or an inert atmosphere at a temperature in the range of 700 to 1000° C. so as to cause oxygen from the oxide layer to diffuse into the article.

According to a second aspect of the present invention, there is provided a method of case hardening an article formed of titanium, zirconium or an alloy of titanium and/or zirconium, said method comprising the steps of (a) heat-treating the article formed of titanium, zirconium or alloy of titanium and/or zirconium in an oxidising atmosphere at a temperature in the range of 700 to 1000° C. so as to form an oxide layer on the article; and (b) further heat-treating the article in a vacuum or in a neutral or an inert atmosphere at a temperature in the range of 700 to 1000° C. so as to cause oxygen from the oxide layer to diffuse into the article whereby to produce a sigmoid-shaped hardness profile.

The time for heat-treatment in step (a) is relatively short and depends, inter alia, upon the nature of the oxidising medium and the intended use of the article. Typically, the time may be, for example, from 0.1 to 1 hour, preferably 0.3 to 0.6 hour.

The heat-treatment in step (a) is conveniently effected at atmospheric pressure.

Steps (a) and (b) may be repeated at least once.

In the method according to said second aspect of the present invention, the oxidising atmosphere in step (a) preferably comprises oxygen as well as nitrogen, as this improves the adhesion of the predominantly oxide scale thus formed.

In the first and second aspects of the present invention, the oxidising atmosphere in step (a) is preferably air. The temperature in step (a) is preferably 700 to 900° C., more preferably 800 to 900° C., and most preferably about 850° C.

The temperature in step (b) is preferably 700 to 900° C., more preferably about 800 to 900° C., and most preferably about 850° C. It is most preferred to effect treatment step (b) in a vacuum, in which case the pressure is preferably not more than $1.3\times10^{-2}$ Pa($1\times10^{-4}$ Torr) Pa, and is conveniently about $1.3\times10^{-4}$ Pa ($1\times10^{-6}$ Torr). The use of a vacuum is much preferred because it reduces the risk of unwanted contaminants being accidently introduced into the surface of the article during step (b).

In particular, it is important to prevent gaseous oxygen from reaching the solid surface during step (b) where it may dissolve or react so as to cause excessive hardness and potential embrittlement. Where the heat treatment in step (b) is effected in an inert or neutral atmosphere, any non-oxidising and non-reducing atmosphere may be employed, such as argon or other inert gas, provided that it contains no or only a low partial pressure of oxygen.

The time required for the heat treatment in step (b) is typically in the range of 10 to 50 hours and may conveniently be about 20 to 30 hours.

It is within the scope of the present invention to follow the treatment steps (a) and (b) with any of a variety of subsequent treatments or processes to reduce friction. In particular, it is within the scope of the present invention to follow the method of the present invention with the treatment method disclosed in our copending PCT Publication No. WO98/02595 for improving the tribological behaviour of a titanium or titanium alloy article. Such process basically involves the gaseous oxidation of the article at a temperature in the range of 500 to 725° C. for 5.0 to 100 hours, the temperature and time being selected such as to produce an adherent and essentially pore-free surface compound layer containing at least 50% by weight of oxides of titanium having a rutile structure and thickness of 0.2 to 2 μm on a solid solution-strengthened diffusion zone where the diffusing element is oxygen and the diffusion zone has a depth of 5 to 50 μm.

The present invention is applicable to commercially pure grades of titanium, titanium alloys (α,α+β, or β alloys), commercially pure grades of zirconium, zirconium alloys and to alloys of zirconium and titanium.

Where the article is required to have good fatigue properties, it may be subjected to a mechanical surface treatment, such as shot peening, after heat treatment in order to restore the fatigue properties which may be reduced by the heat treatment operation.

According to a third aspect of the present invention, there is provided an article formed of a metal or alloy selected from titanium, zirconium, alloys of titanium and alloys of zirconium, said article having a hardened metallic case, strengthened by diffused oxygen; wherein the article has a sigmoid-shaped hardness profile across said hardened case.

Preferably, the depth of the hardened case is greater than 50 μm, and is typically in the range 200 to 500 μm, but may be as great as 1 mm.

A further layer of low-friction material, for example, a nitride, diamond-like-carbon or an oxide layer as described in our co-pending PCT Publication No. WO98/02595, may be provided on top of the hardened case.

Figure 2:
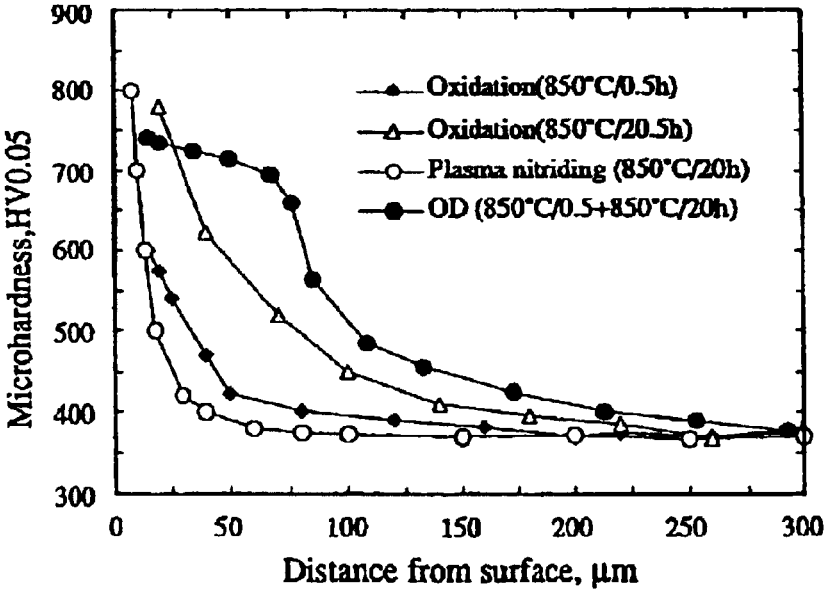
Figure 3:
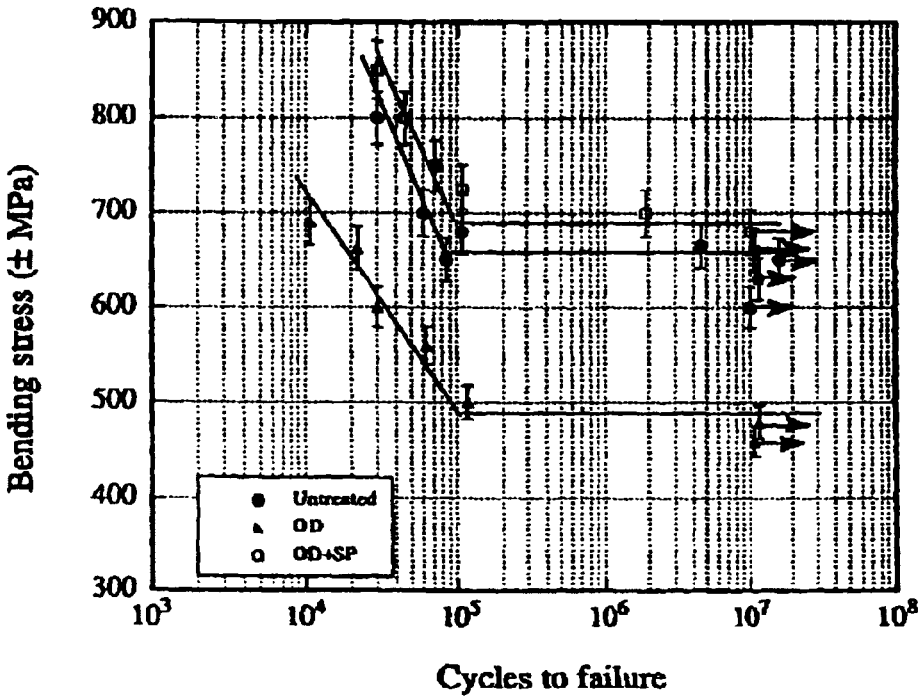
Figure 4:
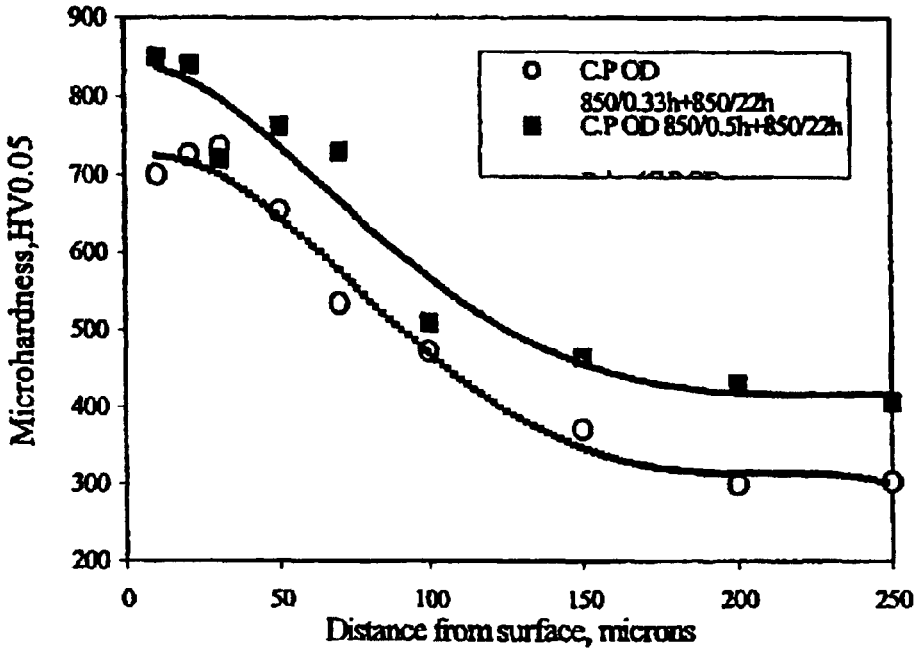
Figure 5:
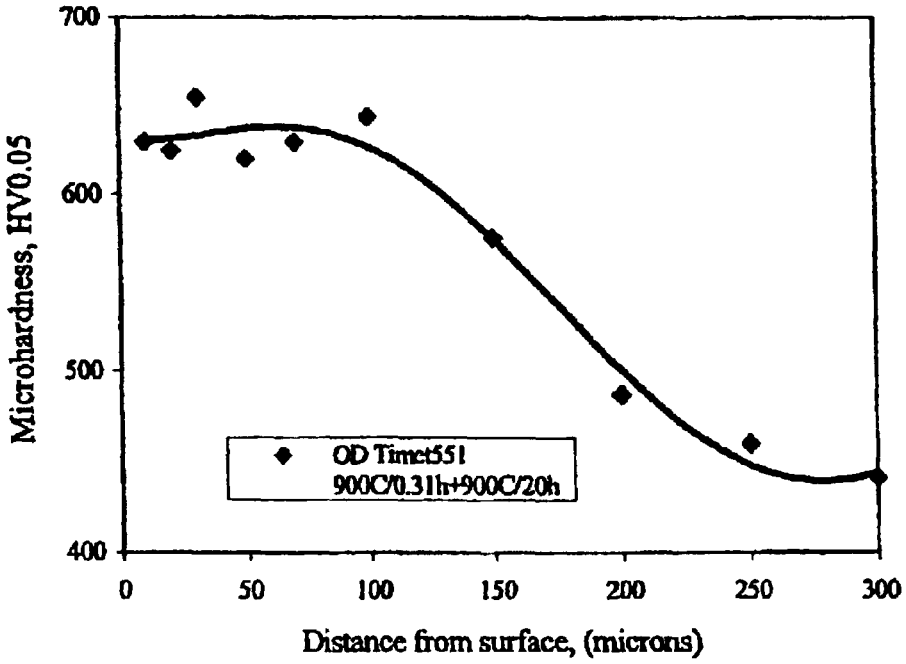
Figure 6:
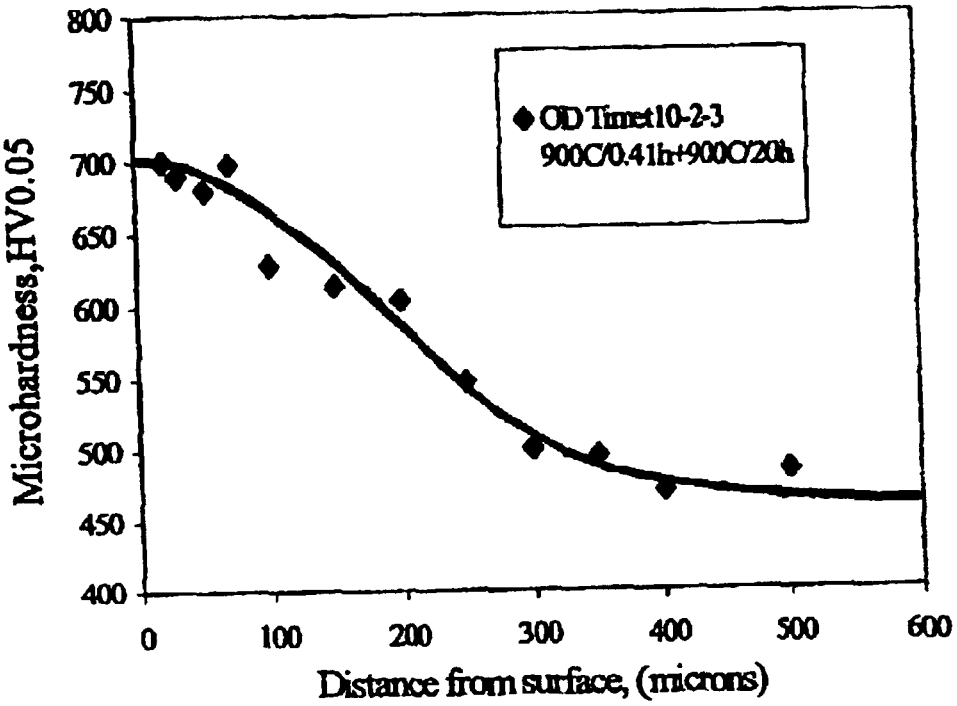

In the accompanying drawings:

FIG. 1 is an SEM micrograph showing the overall microstructure of a sample of an oxygen-diffused (OD) Ti6Al4V material treated in accordance with the method of the present invention, FIG. 2 is a graph showing microhardness profiles for the OD Ti6Al4V material produced in accordance with the present invention and for other surface-treated articles formed of the same material (Ti6Al4V), FIG. 3 is a graph showing the effect of OD treatment and OD plus shot peening (OD+SP) on the fatigue properties of Ti6Al4V, FIG. 4 is a graph showing microhardness profiles for OD C.P titanium material, produced in accordance with the present invention, FIG. 5 is a graph showing a microhardness profile for OD Timet551 produced in accordance with the present invention, and FIG. 6 is a graph showing a microhardness profile for OD Timet10-2-3 material, produced in accordance with the present invention.

Samples of Ti6Al4V in the form of cylindrical coupons of 5 mm thickness, cut from a 25 mm diameter bar were used. The samples were then thoroughly cleaned and subsequently thermally oxidised at 850° C. for 30 minutes in air in a muffle furnace. After being allowed to cool, the samples were subjected to a further heat treatment operation at 850° C. for 20 hours in a vacuum furnace (about $1.3\times10^{-4}$ Pa=about $10^{-6}$ Torr). Alternatively, the steps of (a) thermal oxidation and (b) further heat treatment can be carried out in a single vacuum furnace, step (a) being effected in air and step (b) being effected at $1.3\times10^{-4}$ Pa after evacuation of the air.

It was noted that, after thermal oxidation at 850° C. for 30 minutes, the samples had a dark brown appearance. However, this changed to silver following the further heat treatment operation. The metallography of the oxygen-diffused treated sample is shown in FIG. 1. A hardened layer was produced which was which was estimated from the transition in morphology to have a depth of about 300 μm and appeared (from the different etching effects) to consist of two sub-layers, the first sub-layer having a depth of about 80 μm and the second sub-layer, lying under the first sub-layer, having a depth of about 220 μm.

A typical microhardness profile for the above-treated samples is illustrated in FIG. 2 where, for comparison purposes, microhardness profiles are also given for samples of the same Ti6Al4V material treated by one of three processes, namely oxidation at 850° C. for 30 minutes, oxidation at 850° C. for 20.5 hours and plasma nitriding at 850° C. for 20 hours in an atmosphere of 25% $N_2$ and 75% $H_2$. It is notable that the OD material treated in accordance with the present invention showed the desired sigmoid hardness profile with a more pronounced hardening effect in terms of higher hardness and deep-hardened zone than the thermally oxidised material with the same thermal cycle (850° C./20.5 hours). The microhardness profile for the OD material in accordance with the present invention is in good agreement with the observed microstructural features illustrated in FIG. 1.

As can be seen from FIG. 2, the OD samples produced in accordance with the present invention had a high hardness (greater than 700 $HV_{0.05}$) in the first 80 μm and a total hardened layer of about 300 μm in depth.

As can be seen from FIG. 3, OD treatment in accordance with the present invention reduces the fatigue properties of Ti6Al4V. However, the reduction in the fatigue limit was totally restored and slightly elevated by about 30 MPa over the untreated material by shot peening. In this particular case, the shot peening was effected using C glass shot with an Almen density of 0.15–0.029N.

As noted above, the samples treated in accordance with the present invention possessed a significantly greater depth of hardening effect than a direct oxidation treatment at the same temperature and for the same total time (850° C./20.5 hours). This means that the treatment in accordance with the present invention not only avoids the formation of an undesirable scale, which always occurs as a result of oxidation treatment at high temperature, but also confers a greater case hardening effect. This phenomenon at first seems difficult to understand since, in both instances, a high oxygen potential exists at the air/oxide interface for the oxidation treatment or at the oxide/Ti interface for the treatment in accordance with the present invention. It is known that oxidation of titanium is controlled by oxygen diffusion in the diffusion zone rather than in the oxide, since the diffusion coefficient for oxygen in $TiO_2$ is about 50 times that in α-Ti at the same temperature. Therefore, there is no reason to relate to the difference in the hardening effect between the process of the present invention conducted at 850° C. for a total time of 20.5 hours and a simple oxidation treatment effected at 850° C. for 20.5 hours, to the diffusion resistance of oxygen passing through the oxide layer.

Without prejudice to the present invention, it is theorised that the above phenomenon is caused by the retarding effect of nitrogen (from the air) on the diffusion of oxygen. During prolonged treatment in air, a build-up of nitrogen atoms may occur at the oxide/metal interface (see A. M. Chaze et al, Journal of Less-Common Metals, 124 (1986) pages 73 to 84 ) and may act as a block on the inward diffusion of oxygen. In the above described process according to the present invention, no further nitrogen is admitted during vacuum treatment and the blocking effect is therefore much reduced.

The examples quoted above for the alloy Ti-6A1-4V, have been case hardened using process parameters that have substantially been optimised for that alloy. In order to demonstrate that the process is equally applicable to other alloys of titanium, a limited number of samples of C.P titanium, Timet551 and Timet10-2-3 have also been treated. The following examples are for demonstration only and do not necessarily represent an optimised process.

Samples of C.P titanium in the form of rectangular blocks of 20×10×10 mm, cut from a 10 mm thick sheet, were used. The samples were degreased and then thermally oxidised in air at 850° C. for 20–30 minutes. After cooling, the samples were subjected to a further heat treatment operation at 850° C. for 22 hours in a vacuum furnace (about $1\times10^{-6}$ Torr= about $1.3\times10^{-4}$ Pa).

Samples of Timet551 in the form of rectangular blocks of 30×10×10 mm, cut from a 90 mm diameter bar, were used. The samples were degreased and then thermally oxidised in air at 900° C. for 19 minutes. After cooling, the samples were subjected to a further heat treatment operation at 900° C. for 20 hours in a vacuum furnace (about $1\times10^{-6}$ Torr= about $1.3\times10^{-4}$ Pa).

Samples of Timet10-2-3 in the form of rectangular blocks of 30×10×10 mm, cut from a 260 mm diameter forged disc, were used. The samples were degreased and then thermally oxidised in air at 900° C. for 25 minutes. After cooling, the samples were subjected to a further heat treatment operation at 900° C. for 20 hours in a vacuum furnace (about $1\times10^{-6}$ Torr=about $1.3\times10^{-4}$ Pa).

It was noted that, after thermal oxidation, the C.P and Timet551 samples exhibited a grey appearance, whereas the Timet10-2-3 material exhibited a black appearance.

As can be seen from FIGS. 4 and 5, the C.P and Timet551 hardness profiles exhibit the same type of sigmoid shape as FIG. 2 (OD) but 20 $\mu$m deeper penetration in the case of Timet551 (c.f. FIG. 2); the slightly lower hardness and deeper penetration being attributed to the 20 hour 900° C. diffusion step.

As can be seen from FIG. 6, the metastable $\beta$ material has developed a much deeper hardening compared with the $\alpha+\beta$ titanium alloys. The deeper penetration of the oxygen can firstly be attributed to the higher diffusivity of oxygen in the $\beta$ phase (see Z. Liu and Welsch, Metallurgical Trans. A, Vol. 19A, Apr. 1988, pg1121–1125) and also to a much thicker oxide layer which developed during step (a), compared with the $\alpha+\beta$ titanium alloys.

In some alloys, the thermochemical treatment carried out in step (a) and/or step (b) of the case hardening process may alter the microstructure and mechanical properties of the core material. In such cases, a further heat treatment may be carried out after the case hardening process in order to restore or optimise the core properties.

It is important in the present invention that the scale formed during step (a) should remain adherent to the surface in order to provide the oxygen reservoir required for step (b). Depending on the alloy, the adhesion of the scale during step (a) can be affected not only by the time and temperature employed but also by the nature of the oxidising atmosphere and by the surface finish and geometrical shape of the surface treated. When titanium is oxidised at around 850° C., the scale formed is significantly more adherent if the oxidising atmosphere is air rather than pure oxygen, and a model has been proposed to explain this as an effect of the presence of nitrogen. Our experiments have confirmed the superiority of an air atmosphere over oxygen in this respect, and it is therefore not only more economical but also a technically preferred option to use air as the oxidising atmosphere in step (a). The surface finish applied to all samples here described was obtained by finishing on 1200 grade SiC paper and this generally gave good adhesion.

It is to be understood that the case hardening process here described results in a relatively deep case of hardened material which enables it to withstand the sub-surface Hertzian stresses developed by high contact loads. The resultant surface has therefore a high load-bearing capacity, but this does not, of itself, confer good wear resistance to the surface. In order to obtain a surface with low friction, which is resistant to scuffing and galling, it will be necessary to apply a further layer or coating to the case hardened surface, or other surface treatment. Coatings, which have successfully been applied to the case hardened surface, include plasma nitriding, a diamond-like carbon coating, and the coating produced by the process described in our copending PCT Publication WO98/02595.

What is claimed is:

1. A method of case hardening an article formed of at least one material selected from the group consisting of titanium, zirconium, alloys of titanium, alloys of zirconium and alloys of titanium and zirconium, said method comprising the steps of (a) heat-treating said article in an oxidising atmosphere at a temperature in the range of 700 to 1000° C. so as to form an oxide layer on the article; and (b) further heat-treating the article in a vacuum or in a neutral or an inert atmosphere at a temperature in the range of 700 to 1000° C. so as to cause oxygen from the oxide layer to diffuse into the article whereby to produce a sigmoid-shaped hardness profile.

2. A method as claimed in claim 1, wherein the oxidising atmosphere contains both oxygen and nitrogen.

3. A method as claimed in claim 2, wherein the oxidising atmosphere in step (a) is air.

4. A method as claimed in claim 1, wherein the time for heat-treatment in step (a) is from 0.1 to 1 hour.

5. A method as claimed in claim 1, wherein the time for heat-treatment in step; (a) is from 0.3 to 0.6 hour.

6. A method as claimed in claim 1, wherein the heat-treatment in step (a) is effected at atmospheric pressure.

7. A method as claimed in claim 1, wherein steps (a) and (b) are repeated at least once.

8. A method as claimed in claim 1, wherein the temperature in step (a) is 700 to 900° C.

9. A method as claimed in claim 8, wherein the temperature in step (a) is 800 to 900° C.

10. A method as claimed in claim 1, wherein the temperature in step (b) is 700 to 900° C.

11. A method as claimed in claim 10, wherein the temperature in step (b) is 800 to 900° C.

12. A method as claimed in claim 1, wherein the heat treatment in step (b) is effected at a pressure of not more than $1.3\times10^{-2}$ Pa ($1\times10^{-4}$ Torr).

13. A method as claimed in claim 12, wherein the heat treatment in step (b) is effected at a pressure of about $1.3\times10^{-4}$ Pa ($1\times10^{-6}$ Torr).

14. A method as claimed in claim 1, wherein the heat treatment in step (b) is effected for a time in the range of 10 to 30 hours.

15. An article formed of a metal or alloy selected from the group consisting of titanium, zirconium, alloys of titanium and alloys of zirconium, said article having a hardened metallic case, strengthened by diffused oxygen; wherein the article has a sigmoid-shaped hardness profile across said hardened case.

16. An article as claimed in claim 15, wherein the depth of the hardened case is greater than 50 $\mu$m.

17. An article as claimed in claim 15, wherein the depth of the hardened case is in the range 200 to 500 $\mu$m.

18. An article as claimed in claim 15, further comprising a layer of low-friction material provided on top of the hardened case.

19. A method of case hardening an article formed of at least one material selected from the group consisting of titanium, zirconium, alloys of titanium, alloys of zirconium and alloys of titanium zirconium, said method comprising the steps of (a) heat-treating said article in an oxidising atmosphere containing both oxygen and nitrogen at a temperature in the range of 700 to 1000° C. so as to form an oxide layer on the article; and (b) further heat-treating the article in a vacuum or in a neutral or an inert atmosphere at a temperature in the range of 700 to 1000° C. so as to cause oxygen from the oxide layer to diffuse into the article, wherein the time for heat-treatment in step (a) is from 0.1 to 1 hour.

20. A method of case hardening an article formed of at least one material selected from the group consisting of titanium, zirconium, alloys of titanium, alloys of zirconium and alloys of titanium zirconium, said method comprising the steps of (a) heat-treating said article in an oxidising atmosphere containing both oxygen and nitrogen at a temperature in the range of 700 to 1000° C. so as to form an oxide layer on the article; and (b) further heat-treating the article in a vacuum or in a neutral or an inert atmosphere at a temperature in the range of 700 to 1000° C. so as to cause oxygen from the oxide layer to diffuse into the article, wherein the heat treatment in step (b) is effected at a pressure of not more than $1.3\times10^{-2}$ Pa ($1\times10^{-4}$ Torr).

* * * * *